US009637353B2

(12) United States Patent
Anquan et al.

(10) Patent No.: US 9,637,353 B2
(45) Date of Patent: May 2, 2017

(54) MONITORING MODULE AND ESCALATOR/AUTOWALK INCLUDING THE MONITORING MODULE

(71) Applicant: KONE Corporation, Helsinki (FI)

(72) Inventors: Jim Jin Anquan, Suzhou (CN); Yi Ding Wang, Suzhou (CN)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/042,805

(22) Filed: Feb. 12, 2016

(65) Prior Publication Data

US 2016/0236911 A1 Aug. 18, 2016

(30) Foreign Application Priority Data

Feb. 16, 2015 (CN) ..... 2015 1 0085502

(51) Int. Cl.

| | |
|---|---|
| ***B66B 25/00*** | (2006.01) |
| ***B66B 27/00*** | (2006.01) |
| ***H01H 9/54*** | (2006.01) |
| ***B66B 29/00*** | (2006.01) |
| ***B66B 5/00*** | (2006.01) |

(52) U.S. Cl.

CPC ..... *B66B 27/00* (2013.01); *B66B 5/0031* (2013.01); *B66B 29/005* (2013.01); *H01H 9/54* (2013.01)

(58) Field of Classification Search

CPC ..... B66B 29/00; B65G 43/02; B65G 43/06
USPC ..... 198/322, 323, 502.4, 810.03, 327, 326, 198/330
See application file for complete search history.

(56) References Cited

U.S. PATENT DOCUMENTS

| | | | | |
|---|---|---|---|---|
| 3,680,416 | A * | 8/1972 | Van Dijk | B23B 29/04 82/158 |
| 3,986,595 | A * | 10/1976 | Asano | B66B 29/02 104/25 |
| 5,443,145 | A * | 8/1995 | Schoeneweiss | B66B 29/04 198/323 |
| 7,497,315 | B2 * | 3/2009 | Fargo | B66B 23/02 198/322 |
| 7,730,955 | B2 * | 6/2010 | Farquhar | E21B 43/103 166/380 |
| 2009/0266674 | A1 * | 10/2009 | Mueller | G01D 18/008 198/322 |

* cited by examiner

*Primary Examiner* — Gene Crawford
*Assistant Examiner* — Lester Rushin
(74) *Attorney, Agent, or Firm* — Birch, Stewart, Kolasch & Birch, LLP

(57) ABSTRACT

The present disclosure relates to a monitoring module and an escalator/autowalk including the monitoring module. A monitoring device comprises: a first component disposed on one of the driving device of the escalator or autowalk and a fixed device; and a recess portion disposed on the other of the driving device of the escalator or autowalk and the fixed device and configured to receive at least a part of the first component; wherein a relative movement between the recess portion and the first component triggers the first component so as to indicate a movement of the driving device. By applying the monitoring device of the present disclosure, it is possible to achieve monitoring the movement of the driving device of the escalator or autowalk in multiple directions.

18 Claims, 3 Drawing Sheets

MONITORING MODULE AND ESCALATOR/AUTOWALK INCLUDING THE MONITORING MODULE

TECHNICAL FIELD

The present disclosure relates to the field of elevator, and more particularly to a monitoring module for monitoring a movement of a driving device of an escalator or an autowalk, and the escalator or autowalk using the monitoring module.

BACKGROUND OF THE INVENTION

An escalator or an autowalk is widely used in people's daily life, and it is used to carry passengers from one height to another, or to carry passengers from one end to the other. The driving device of the escalator or autowalk usually includes a motor, gears, stairsteps or plate driver module, and an armrest driver module, etc. At present, monitoring the driving device of the escalator or autowalk is mainly to obtain for example rotation speeds or rotation directions of the motor, so as to monitor and get rid of the faults of overspeed or inversion, etc.

However, an abnormal movement or displacement may also occur in the driving device per se of the escalator or autowalk. For example, in a horizontal direction, the driving device may have an overtravel movement, that is to say, the movement of the driving device in a horizontal direction exceeds the scope of its normally allowed movement. For another example, the driving device may also have an upthrust under the action of external force. These abnormal movements mean that failure or damage may have occurred in the driving device and/or a device associated with it, while this kind of failure or damage will bring a large security risk, and thus it is necessary to monitor the abnormal movements of the driving device to timely find and get rid of the failure, thereby ensuring the safety of the passengers.

SUMMARY OF THE INVENTION

The main idea of the present disclosure lies in providing a monitoring device for monitoring a movement of a target object, and especially the monitoring device can monitor the movement of the driving device of the escalator or autowalk, for example, the overtravel movement of the driving device in a horizontal direction and/or the upthrust of the driving device. Thus, it is possible to implement monitoring the abnormal movement of the driving device, thereby efficiently getting rid of the security risk.

According to one embodiment of the first aspect of the present disclosure, there is provided a monitoring device for monitoring a movement of a first object, the monitoring device comprising: a first component disposed on one of the first object and a second object; and a recess portion disposed on the other of the first object and the second object and configured to receive at least a part of the first component; wherein a relative movement between the recess portion and the first component triggers the first component so as to indicate the movement of the first object.

By applying the monitoring device in the above embodiment of the present disclosure, it is possible to achieve monitoring the movement of the first object in multiple directions.

According to one embodiment of the second aspect of the present disclosure, there is provided a monitoring device for monitoring a movement of a driving device of an escalator or autowalk, the monitoring device comprising: a first component disposed on one of the driving device of the escalator or autowalk and a fixed device; and a recess portion disposed on the other of the driving device of the escalator or autowalk and the fixed device and configured to receive at least a part of the first component; wherein a relative movement between the recess portion and the first component triggers the first component so as to indicate the movement of the driving device.

By applying the monitoring device in the above embodiment of the present disclosure, it is possible to achieve monitoring the movement of the driving device of an escalator or autowalk in multiple directions.

In one example, the recess portion comprises a bottom and a side, and the relative movement between the recess portion and the first component triggering the first component so as to indicate the movement of the driving device comprises: a relative movement between the bottom of the recess portion and the first component triggering the first component so as to indicate the movement of the driving device in a first direction, and a relative movement between the side of the recess portion and the first component triggering the first component so as to indicate the movement of the driving device in a second direction. The first direction may be for example an upthrust direction of the driving device, and the second direction may be for example a horizontal movement direction of the driving device.

When a damage or failure occurs in the driving device of the escalator or autowalk or the device associated with it to cause the driving device to have an upthrust and/or have an overtravel movement in a horizontal direction, it is possible to achieve, by the monitoring device in this example, monitoring the abnormal horizontal movement and/or upthrust movement of the driving device, thereby efficiently getting rid of the security risk.

Beneficially, the recess portion is formed with a fluid-guided structure for guiding fluid within the recess portion out of the recess portion. When the escalator or autowalk is mounted in some environments (for example, outdoor) so that the recess portion may be exposed to the outside world, liquid may be deposited within the recess portion, and by forming a fluid-guided structure on the recess portion, it is possible to guide the oil or water within the recess portion out of the recess portion.

The recess portion may have for example a variable cross-section or a uniform cross-section. The first component may be for example a contact switch that is triggered in a contact manner or a non-contact switch that is triggered in a non-contact manner.

In one example, the recess portion may be integrally formed on the driving device or the fixed device. In another example, the recess portion may be coupled to the driving device or the fixed device as a separate component.

The fixed device may be for example a truss of the escalator or autowalk.

According to one embodiment of the third aspect of the present disclosure, there is provided a monitoring device for monitoring a movement of a driving device of an escalator or autowalk, the monitoring device comprising: a limit switch disposed on one of the driving device of the escalator or autowalk and a fixed device; and a recess portion disposed on the other of the driving device of the escalator or autowalk and the fixed device and configured to receive at least a part of the limit switch, the recess portion having a conical sidewall with a revolution axis or a slanted sidewall with an axis; wherein a relative movement between the recess portion and the limit switch triggers a movement of the limit switch along the revolution axis of the conical sidewall or the axis of the slanted sidewall so as to indicate the movement of the driving device.

According to one embodiment of the fourth aspect of the present disclosure, there is provided an escalator or autowalk, comprising: a driving device; and a monitoring device, the monitoring device comprising: a first component disposed on one of the driving device and a fixed device; and a recess portion disposed on the other of the driving device and the fixed device and configured to receive at least a part of the first component; wherein a relative movement between the recess portion and the first component triggers the first component so as to indicate a movement of the driving device.

BRIEF DESCRIPTION OF THE DRAWINGS

Other features, objects and advantages of the present disclosure will become more obvious by making references to the following detailed description of nonrestrictive embodiments in conjunction with the accompanying drawings.

In these figures, throughout different schematic views, the same or similar reference signs denote the same or similar devices (modules) or steps.

DESCRIPTION OF PREFERRED EMBODIMENTS

In the following detailed description of the preferred embodiments, the appended accompanying drawings constituting part of the present disclosure will be referred to. The appended accompanying drawings illustrate by way of example the particular embodiments which are able to implement the present disclosure. The exemplary embodiments do not aim to exhaust all embodiments of the present disclosure. It can be understood that without departure from the scope of the present disclosure, other embodiments can be used, and structural or logical modifications can also be carried out. Thus, the detailed descriptions below are not restrictive, and the scope of the present disclosure is defined by the appended claims.

The present disclosure provides a monitoring device for monitoring a movement of a first object. The monitoring device comprises a first component and a recess portion. The first component is disposed on one of the first object and a second object. The recess portion is disposed on the other of the first object and the second object and is configured to receive at least a part of the first component. A relative movement between the recess portion and the first component triggers the first component so as to indicate the movement of the first object.

The monitoring device in above embodiments of the present disclosure is applicable to any suitable application scenarios in which a movement of an object needs to be monitored. For example, in one embodiment, the monitoring device may be used to monitor the movement of the driving device of the escalator or autowalk. Below, respective embodiments of the present disclosure will be described in detail with respect to the application scenarios.

Figure 1:
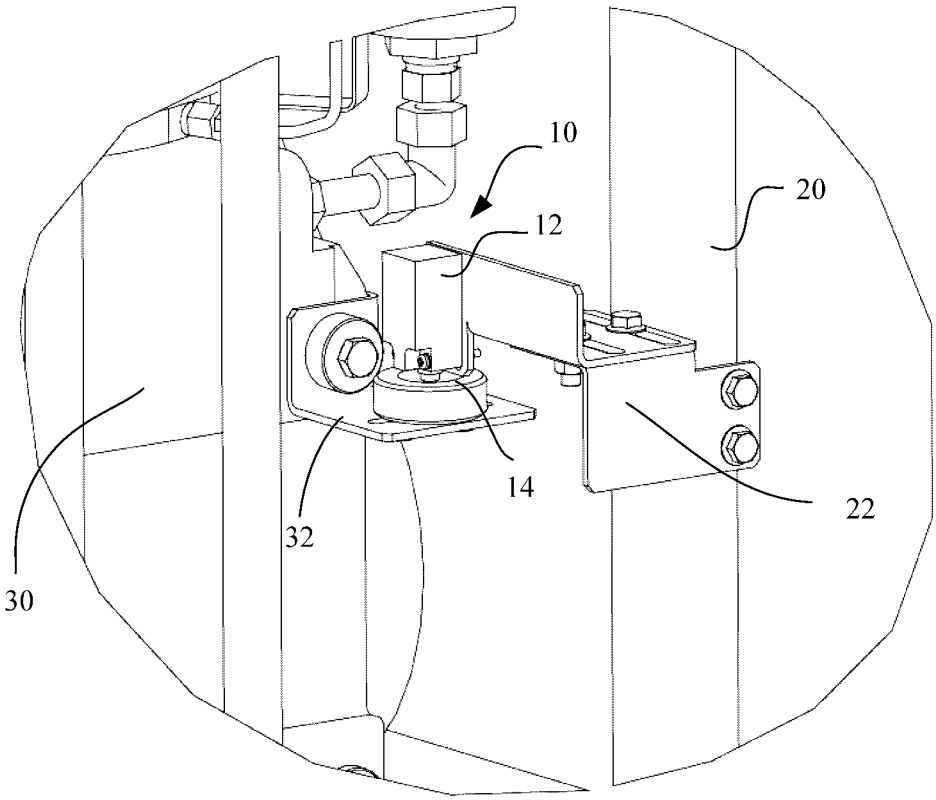
FIG. 1 illustrates a schematic view of a monitoring device for monitoring a movement of a driving device of the escalator or autowalk according to one embodiment of the present disclosure.

FIG. 1 illustrates a schematic view of the monitoring device for monitoring the movement of the driving device of the escalator or autowalk according to one embodiment of the present disclosure. Referring to FIG. 1, an exemplary monitoring device 10 comprises a first component 12 and a recess portion 14. The first component 12 is disposed on a truss 20 of the escalator or autowalk. Specifically, the first component 12 may be connected to the truss 20 via for example a bracket 22. The recess portion 14 is disposed on a driving device 30 of the escalator or autowalk. Specifically, the recess portion 14 may be connected to the driving device 30 via for example a bracket 32. It can be understood that it is only an example to connect the first component 12 to the truss 20 and connect the recess portion 14 to the driving device 30 via brackets, and any other suitable connecting manners can be adapted to connect the first component 12 to the truss 20 and connect the recess portion 14 to the driving device 30 such as buckle connection, adherens junction, etc.

After the completion of the assembly, at least one part of the first component 12 is received in the recess portion 14. The first component 12 can be implemented via multiple manners. For example, it can be a contact switch that is triggered in a contact manner, such as a limit switch, a micro switch, a metal rod, etc., or it can also be a non-contact switch that is triggered in a non-contact manner, such as a proximity switch, etc. The recess portion 14 can also be implemented via multiple manners, for example, it can be a variable cross-section body such as a cone shape, a truncated cone shape, a hemispherical shape, etc., or it can also be a uniform cross-section body such as a cylinder, a cube, a rectangle, etc. It can be understood that the kinds of the first component and the types of the recess portion listed here are only exemplary, rather than restrictive, and other kinds of the first component and types of the recess portion that can achieve the objective of the present disclosure can also be applied to the technical solution of the present disclosure.

In a practical application, if a damage or failure occurs in the driving device 30 or the device associated with it so that the driving device 30 per se generates abnormal movements or displacements, the relative movement between the recess portion 14 and the first component 12 will trigger the first component 12 to indicate that a movement of the driving device 30 has occurred. For example, the first element 12 after being triggered may generate a trigger signal that can be provided to a control device, based on which the control device can control the escalator or autowalk to stop, thereby ensuring the safety of the passengers.

Figure 2:
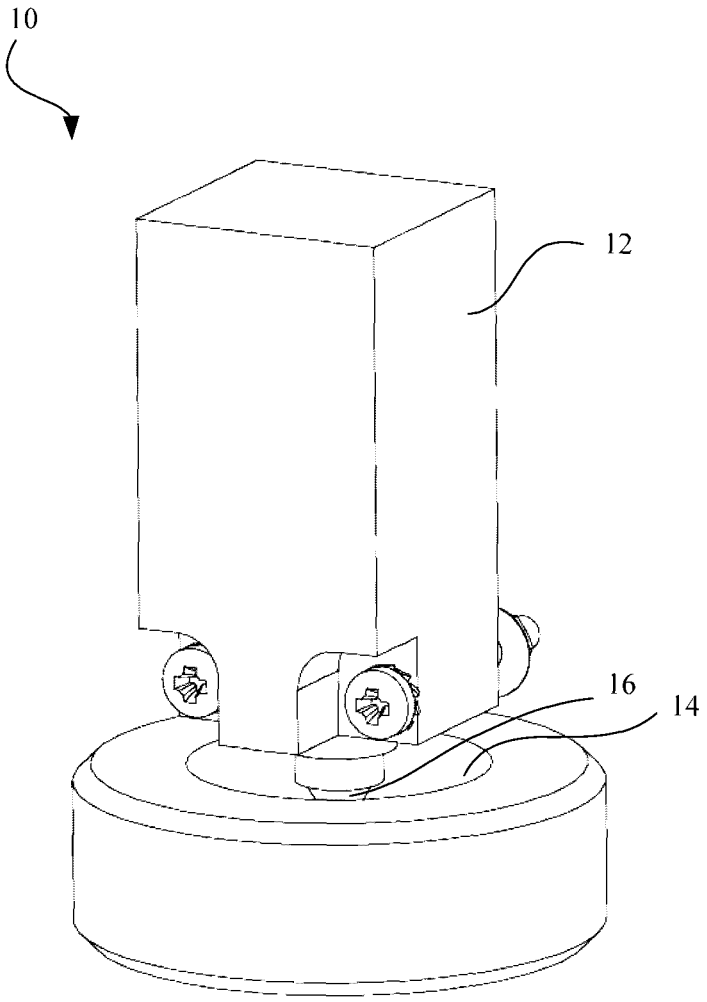
FIG. 2 illustrates an amplified schematic view of the monitoring device in FIG. 1.
Figure 3:
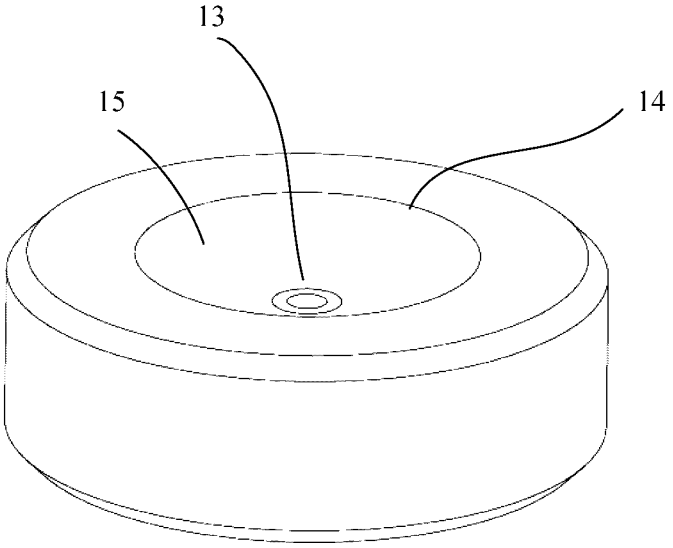
FIG. 3 illustrates an amplified schematic view of a recess portion of the monitoring device in FIG. 1.

The following description is made based on an example in which the first component 12 is a limit switch triggered in a contact manner and the recess portion 14 is in a truncated cone shape. Referring to FIG. 2 and FIG. 3, the limit switch 12 includes a contact 16, and the contact 16 is received in the recess portion 14. The truncated cone-shaped recess portion 14 includes a bottom 13 and a side 15. Usually, the driving device of the escalator or autowalk has a horizontal movement within a normal scope under a normal running state, while the monitoring device in the present disclosure aims to monitor an abnormal horizontal movement outside of the normal horizontal movement. In addition, the driving device generally will not have an upthrust movement under a normal running state, while the monitoring device in the present disclosure further aims to monitor the upthrust movement of the driving device. In order to accurately monitor the abnormal horizontal movement and upthrust movement of the driving device 30, it is necessary to select a limit switch 12 having a suitable action travel and/or angle, and when placing the limit switch 12 into the recess portion 14, it is necessary to consider a suitable position for placing the limit switch 12, for example, the size of the gap between its contact 16 and the bottom 13 or side 15 of the recess portion 14 so as to ensure that the monitoring device 10 can accurately monitor the abnormal displacement or movement of the driving device 30.

When the driving device 30 per se occurs an abnormal movement or displacement, the contact 16 of the limit switch 12 touches the bottom 13 or side 15 of the truncated cone-shaped recess portion 14 to cause a trigger so as to indicate that a movement of the driving device 30 occurs. For example, when the driving device 30 occurs an upthrust (i.e. a movement in the first direction), the contact 16 of the limit switch 12 will touch the bottom 13 of the truncated cone-shaped recess portion 14 to cause a trigger so as to indicate that an upthrust of the driving device occurs. For another example, when an abnormal horizontal movement (i.e. a movement in a second direction) occurs in the driving device 30, the contact 16 of the limit switch 12 will touch the side 15 of the truncated cone-shaped recess portion 14 to cause a trigger so as to indicate that an abnormal horizontal movement of the driving device occurs. It needs to be noted that monitoring the upthrust and abnormal horizontal movement of the driving device as described here is only an example, and it can be understood that regarding such a truncated cone-shaped recess portion design, it is possible to monitor, through mutual cooperation with the limit switch, the displacement or movement in roughly half a sphere direction.

When the escalator or autowalk is mounted in some environments (for example, outdoor) so that the recess portion 14 may be exposed to the outside world, liquid may be deposited within the recess portion 14. Advantageously, the recess portion 14 may be formed with a fluid-guided structure 18 for guiding fluid such as oil or water that may appear within the recess portion out of the recess portion. For example, the fluid-guided structure 18 may be a through-hole throughout the recess portion 14. It can be understood that any other fluid-guided structure that is adapted to guide fluid within the recess portion out of the recess portion can be applied to the present disclosure.

It needs to be noted that the above embodiments are described based on an example in which the first component 12 is disposed on a truss 20 while the recess portion 14 is disposed on a driving device 30, and it can be understood by those of ordinary skill in the art that in an alternative embodiment, the first component 12 may also be disposed on the driving device 30, and correspondingly the recess portion 14 is disposed on the truss 20. In addition, it needs to be noted that the truss 20 may also be replaced by other fixed devices that are fixed on a certain position and do not move.

It needs to be further noted that the above embodiments are described based on an example in which the recess portion 14 acts as a separate component and is coupled to the driving device 30, and it can be understood by those skilled in the art that in another embodiment, the recess portion 14 may also be integrally formed on the driving device 30.

It needs to be further noted that in the above embodiments, the mounting angle between the recess portion 14 and the first component 12 is only exemplary, and by adjusting the mounting angle between the recess portion 14 and the first component 12, it is possible to achieve monitoring the displacements or movements of the driving device in different directions.

In another alternative embodiment, the recess portion includes a conical sidewall with a revolution axis. When a relative movement occurs between the recess portion and the limit switch, the contact of the limit switch touches the conical sidewall and triggers a movement along the revolution axis of the conical sidewall so as to indicate the movement of the driving device.

In another alternative embodiment, the recess portion includes a slanted sidewall with an axis. When a relative movement occurs between the recess portion and the limit switch, the contact of the limit switch touches the slanted sidewall and triggers a movement along the axis of the slanted sidewall so as to indicate the movement of the driving device.

The present disclosure further provides an escalator or autowalk. The escalator or autowalk comprises a driving device, and a monitoring device described in above embodiments to monitor the movement of the driving device.

It can be understood that embodiments described above are only used for description purpose, rather than limiting the present disclosure, and various modifications and changes as those skilled in the art can understand can be employed, without departure from the spirit and scope of the present disclosure. Such modifications and changes are regarded as within the scope of the present disclosure and the appended claims. The scope of the present disclosure is defined by the appended claims. In addition, any reference signs in the claims shall not be construed as limiting the present disclosure. Using the verb "comprise" and its variations does not exclude the existence of other elements or steps not recited in the claims. The indefinite article "an" or "a" before one element or step does not exclude the existence of multiple elements or steps.

The invention claimed is:

1. A monitoring device for monitoring a movement of a first object, the monitoring device comprising: a first component disposed on one of the first target and a second target; and a recess portion disposed on the other of the first target and the second target and configured to receive at least a part of the first component, wherein a relative movement between the recess portion and the first component triggers the first component so as to indicate the movement of the first object, wherein the recess portion comprises a bottom and a side, and the relative movement between the recess portion and the first component triggering the first component so as to indicate the movement of the first object comprises:

a relative movement between the bottom of the recess portion and the first component triggering the first component so as to indicate the movement of the first object in a first direction, and a relative movement between a side wall of the recess portion and the first component triggering the first component so as to indicate the movement of the first object in a second direction, and wherein the first direction is an upthrust direction of the driving device, and the second direction is a horizontal direction.

2. The monitoring device according to claim 1, wherein the recess portion has a variable cross-section or a uniform cross-section.

3. The monitoring device according to claim 1, wherein the first component is a contact switch that is triggered in a contact manner or a non-contact switch that is triggered in a non-contact manner.

4. A monitoring device for monitoring a movement of a driving device of an escalator or autowalk, the monitoring device comprising:

a first component disposed on one of the driving device of the escalator or autowalk and a fixed device; and a recess portion disposed on the other of the driving device of the escalator or autowalk and the fixed device and configured to receive at least a part of the first component, wherein a relative movement between the recess portion and the first component triggers the first component so as to indicate the movement of the driving device.

5. The monitoring device according to claim 4, wherein the recess portion comprises a bottom and a side, and the relative movement between the recess portion and the first component triggering the first component so as to indicate that the movement of the driving device comprises:

a relative movement between the bottom of the recess portion and the first component triggering the first component so as to indicate the movement of the driving device in a first direction, and a relative movement between the side of the recess portion and the first component triggering the first component so as to indicate the movement of the driving device in a second direction.

6. The monitoring device according to claim 5, wherein the first direction is an upthrust direction of the driving device, and the second direction is a horizontal direction.

7. The monitoring device according to claim 4, wherein the recess portion is formed with a fluid-guided structure for guiding fluid within the recess portion out of the recess portion.

8. The monitoring device according to claim 4, wherein the recess portion has a variable cross-section or a uniform cross-section.

9. The monitoring device according to claim 4, wherein the first component is a contact switch that is triggered in a contact manner or a non-contact switch that is triggered in a non-contact manner.

10. The monitoring device according to claim 4, wherein the recess portion is integrally formed on the driving device or the fixed device, or the recess portion is coupled to the driving device or the fixed device as a separate component.

11. The monitoring device according to claim 4, wherein the fixed device is a truss of the escalator or autowalk.

12. A monitoring device for monitoring a movement of a driving device of an escalator or autowalk, the monitoring device comprising:

a limit switch disposed on one of the driving device of the escalator or autowalk and a fixed device; and a recess portion disposed on the other of the driving device of the escalator or autowalk and the fixed device and configured to receive at least a part of the limit switch, the recess portion having a conical sidewall with a revolution axis or a slanted sidewall with an axis, wherein a relative movement between the recess portion and the limit switch triggers a movement of the limit switch along the revolution axis of the conical sidewall or the axis of the slanted sidewall so as to indicate the movement of the driving device.

13. An escalator or autowalk, comprising:

a driving device; and a monitoring device, the monitoring device comprising:

a first component disposed on one of the driving device and a fixed device; and a recess portion disposed on the other of the driving device and the fixed device and configured to receive at least a part of the first component, wherein a relative movement between the recess portion and the first component triggers the first component so as to indicate a movement of the driving device.

14. The escalator or autowalk according to claim 13, wherein the recess portion comprises a bottom and a side, and the relative movement between the recess portion and the first component triggering the first component so as to indicate a movement of the driving device comprises:

a relative movement between the bottom of the recess portion and the first component triggering the first component so as to indicate the movement of the driving device in a first direction, and a relative movement between the side of the recess portion and the first component triggering the first component so as to indicate the movement of the driving device in a second direction.

15. The escalator or autowalk according to claim 13, wherein the recess portion is formed with a fluid-guided structure for guiding fluid within the recess portion out of the recess portion.

16. The escalator or autowalk according to claim 13, wherein the recess portion has a variable cross-section or a uniform cross-section, and wherein the first component is a contact switch that is triggered in a contact manner or a non-contact switch that is triggered in a non-contact manner.

17. The escalator or autowalk according to claim 13, wherein the fixed device is a truss of the escalator or autowalk.

18. The escalator or autowalk according to claim 14, wherein the first direction is an upthrust direction of the driving device, and the second direction is a horizontal direction.

* * * * *